US009463913B2

(12) United States Patent
Strominger

(10) Patent No.: US 9,463,913 B2
(45) Date of Patent: Oct. 11, 2016

(54) SNACK STORAGE LID FOR A BEVERAGE CUP

(71) Applicant: Bonnie Sussman Strominger, New York, NY (US)

(72) Inventor: Bonnie Sussman Strominger, New York, NY (US)

(73) Assignee: Crazy Minds LLC, New York, NY (US)

( * ) Notice: Subject to any disclaimer, the term of this patent is extended or adjusted under 35 U.S.C. 154(b) by 0 days.

(21) Appl. No.: 13/911,777

(22) Filed: Jun. 6, 2013

(65) Prior Publication Data

US 2014/0103037 A1 Apr. 17, 2014

Related U.S. Application Data

(60) Provisional application No. 61/657,235, filed on Jun. 8, 2012.

(51) Int. Cl.

*B65D 51/28* (2006.01)
*B65D 43/02* (2006.01)
*A47G 19/02* (2006.01)

(52) U.S. Cl.

CPC ..... *B65D 51/28* (2013.01); *A47G 19/065* (2013.01); *B65D 43/0222* (2013.01); *B65D 43/0231* (2013.01); *B65D 2231/022* (2013.01); *B65D 2543/00046* (2013.01); *B65D 2543/00092* (2013.01); *B65D 2543/00296* (2013.01); *B65D 2543/00527* (2013.01); *B65D 2543/00537* (2013.01)

(58) Field of Classification Search

CPC ..... B65D 51/28; B65D 2231/022; B65D 81/3205; B65D 1/04; B65D 2543/00046; B65D 2543/00092; B65D 2543/00296; A47G 2019/122; A47G 19/2272; A47G 19/2222; B01F 13/0022

USPC ..... 220/23.86

See application file for complete search history.

(56) References Cited

U.S. PATENT DOCUMENTS

| | | | | |
|---|---|---|---|---|
| 4,770,318 | A | 9/1988 | Earl | |
| 4,955,503 | A | 9/1990 | Propes | |
| 5,137,210 | A | 8/1992 | Hibbs | |
| 5,180,079 | A | 1/1993 | Jeng | |
| D467,499 | S | 12/2002 | Garza et al. | |
| D480,968 | S | 10/2003 | Atkins et al. | |
| 7,111,748 | B2 * | 9/2006 | Cha | 220/4.27 |
| 7,676,909 | B2 | 3/2010 | MacKenzie et al. | |
| 7,882,991 | B2 | 2/2011 | Schechter | |
| 8,631,957 | B2 | 1/2014 | Dart et al. | |
| 2008/0073415 | A1 * | 3/2008 | Kuighadush | 229/103.1 |
| 2008/0099494 | A1 | 5/2008 | Boukais et al. | |
| 2011/0210126 | A1 | 9/2011 | Vovan | |
| 2012/0168329 | A1 | 7/2012 | Berggren | |
| 2012/0168440 | A1 * | 7/2012 | Nerswick et al. | 220/212 |
| 2012/0273500 | A1 * | 11/2012 | Yao | 220/521 |
| 2013/0001233 | A1 | 1/2013 | Hylton | |
| 2013/0056463 | A1 * | 3/2013 | Buck | A47G 19/065 220/23.83 |
| 2013/0228486 | A1 * | 9/2013 | Buck | 206/459.1 |

* cited by examiner

*Primary Examiner* — Shawn M Braden
(74) *Attorney, Agent, or Firm* — Baker & Hostetler LLP

(57) ABSTRACT

The present disclosure discloses a snack container adapted for use with a beverage container comprising a lid, a beverage container engaging portion shaped to engage a rim portion of a beverage container, at least one sidewall, and a floor, wherein the lid is adapted to open and close for a user thereof.

9 Claims, 12 Drawing Sheets

SNACK STORAGE LID FOR A BEVERAGE CUP

RELATED APPLICATIONS

This application claims priority from provisional application U.S. Application Ser. No. 61/657,235, filed on Jun. 8, 2012, entitled Beverage Cup with Snack Storage, the entire contents of which are expressly incorporated herein in their entirety by reference.

TECHNICAL FIELD

The present disclosure is in the technical field of snack storage technology. More particularly, the present disclosure is in the technical field of snack storage technology, wherein a snack storage container is useable in connection with a beverage container such that the combinations of the two, as a unit, are capable of holding beverages and foods separately and simultaneously in one combination snack and beverage unit. OtheR aspects of the present disclosure include a snack storage container that is resealable, detachable, and may include a covering or lid that never needs to be removed. In addition, some embodiments allow a user to store multiple snacks without intermixing therebetween. Some or all of the features disclosed herein may contribute to the disclosed product making it user friendly, versatile, sanitary, and reusable

BACKGROUND

In the past, there have been patents related to apparatuses capable of holding a beverage and food or two beverages simultaneously in the same unit. The previously disclosed technologies include, but are not limited to: a beverage cup with an attached side pouch for food (Hibbs, U.S. Pat. No. 5,137,210); partitioned cups for two beverages or a beverage and a food (Propes, U.S. Pat. No. 4,955,503; Cha, U.S. Pat. No. 7,111,748; Jeng, U.S. Pat. No. 5,180,079); et al.

SUMMARY

The present disclosure relates to a snack container that may be incorporated into a unit that allows the snack container to be incorporated with a beverage container in a single unit. The present disclosure allows a consumer to hold both a beverage and food in one hand thus enabling free usage of the opposite hand. The present disclosure puts a new twist on an age old pastime of snacking, drinking and entertainment. The multiple designs provided by this disclosure help to eleviate issues that can occur in virtually any arena, i.e. walking, talking on cell, sporting events, amusement parks, theatres, and individuality to allow an individual to create their own combination of snacks and beverages by filling the unit with the components desired by the individual, i.e. various empty designs being sold to mass retailers for the home as well.

Various novel aspects of the present disclosure may include the following. The snack container of the disclosure may universally mate with and/or clip to multiple industry-standard (and non-industry standard) beverage containers (i.e, 12 oz, 16 oz, 24 oz, 36 oz, 44 oz cupes, et al.). In another novel aspect of the disclosure, the snack container may include threads on a bottom portion thereof for mating with corresponding threads on a beverage container. Smaller sizes of the snack container may be provided and marketed as suitable for use with "kids" products or "for kids."

Embodiments of the present disclosure are distinctive in that once the unit is initially filled with snacks and a beverage, the top lid of the unit does not need to be completely removed to access the snacks or beverage. Additionally, multiple embodiments of the present disclosure allow a user to access the snacks and beverage without having to completely remove the lid of the snack container. Different embodiments of the present disclosure may be targeted to different markets depending on their intended use, i.e. to be used with certain types of food/snacks and beverages or in certain environments.

In one embodiment, the present disclosure is comprised of a unit comprising a top portion to hold the snack(s). In this embodiment, the lid for the top portion may be opened to access the snacks by a turn style. In other embodiments the snack portion of the unit may be accessed by a flip top hinged lid.

The above disclosed embodiments can utilize any of the following mechanisms to access the beverage in the beverage portion of the cup. In some embodiments a straw may be utilized that passes through a portal on the lid, through the snack portion of the cup, through the barrier separating the food and beverage portions, and ultimately down into the beverage for sipping. Depending on the embodiment, the straw can pierce through the middle of the cup downwards, the end of the top lid, or pierce through the side of the upper portion of the beverage. The straw may be extra-long in length and bendable, created by multiple compositions of engineering. In alternative embodiments that do not utilize a straw, a sip spout feature that opens and closes is used to access the beverage portion of the cup.

As previously mentioned, the present disclosure comprises a barrier that separates the food container and beverage container portions of the unit. The configuration of the barrier may be dependent upon which variations are used to access the food in the snack portion and beverage in the beverage portion of the unit.

DETAILED DESCRIPTION

Figure 1:
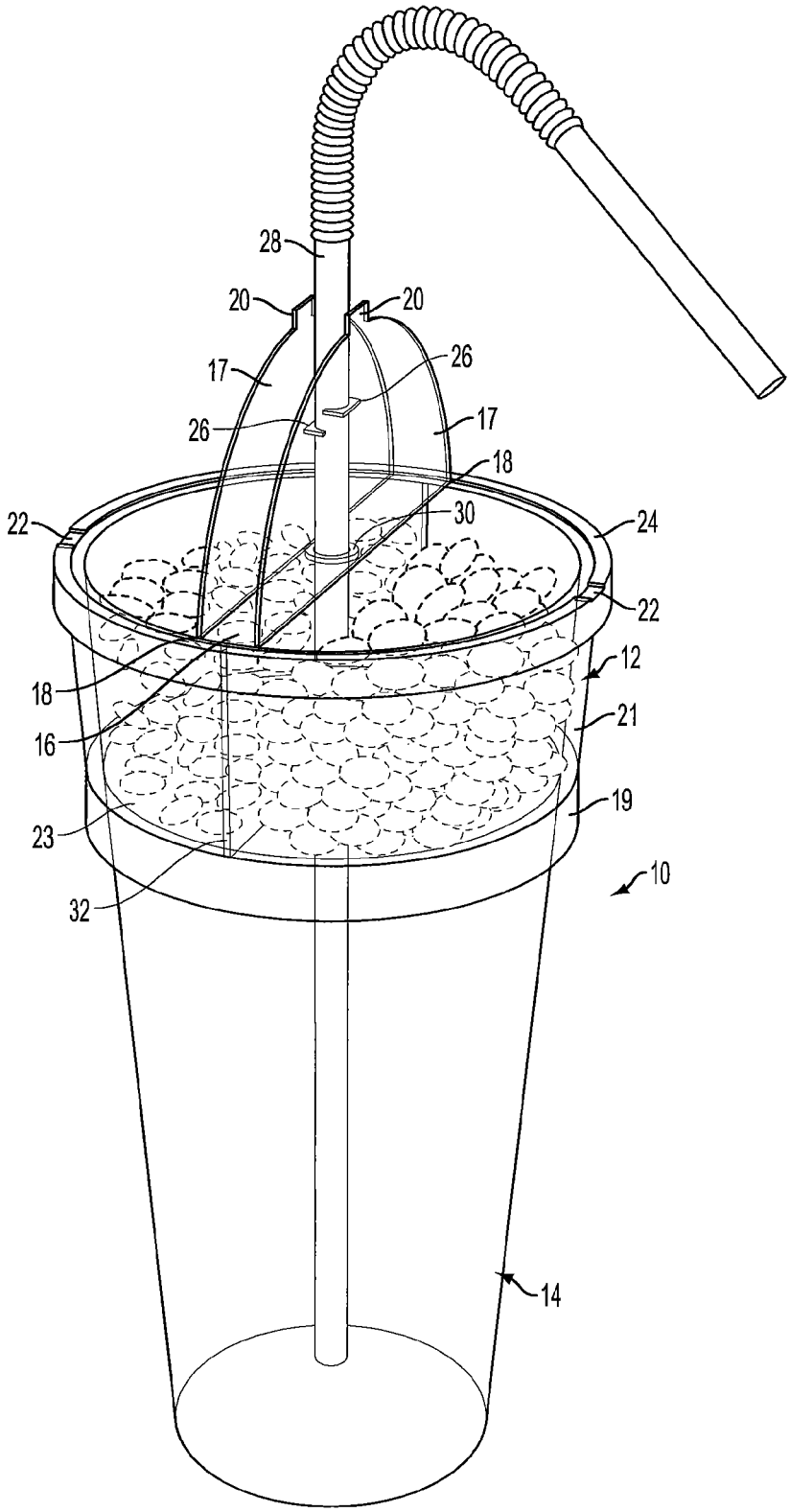
FIG. 1 is a transparent, perspective view of a combination snack container and beverage container incorporated into a single unit in accordance with aspects of the present disclosure having dual hinged lids depicted in an open position.
Figure 2:
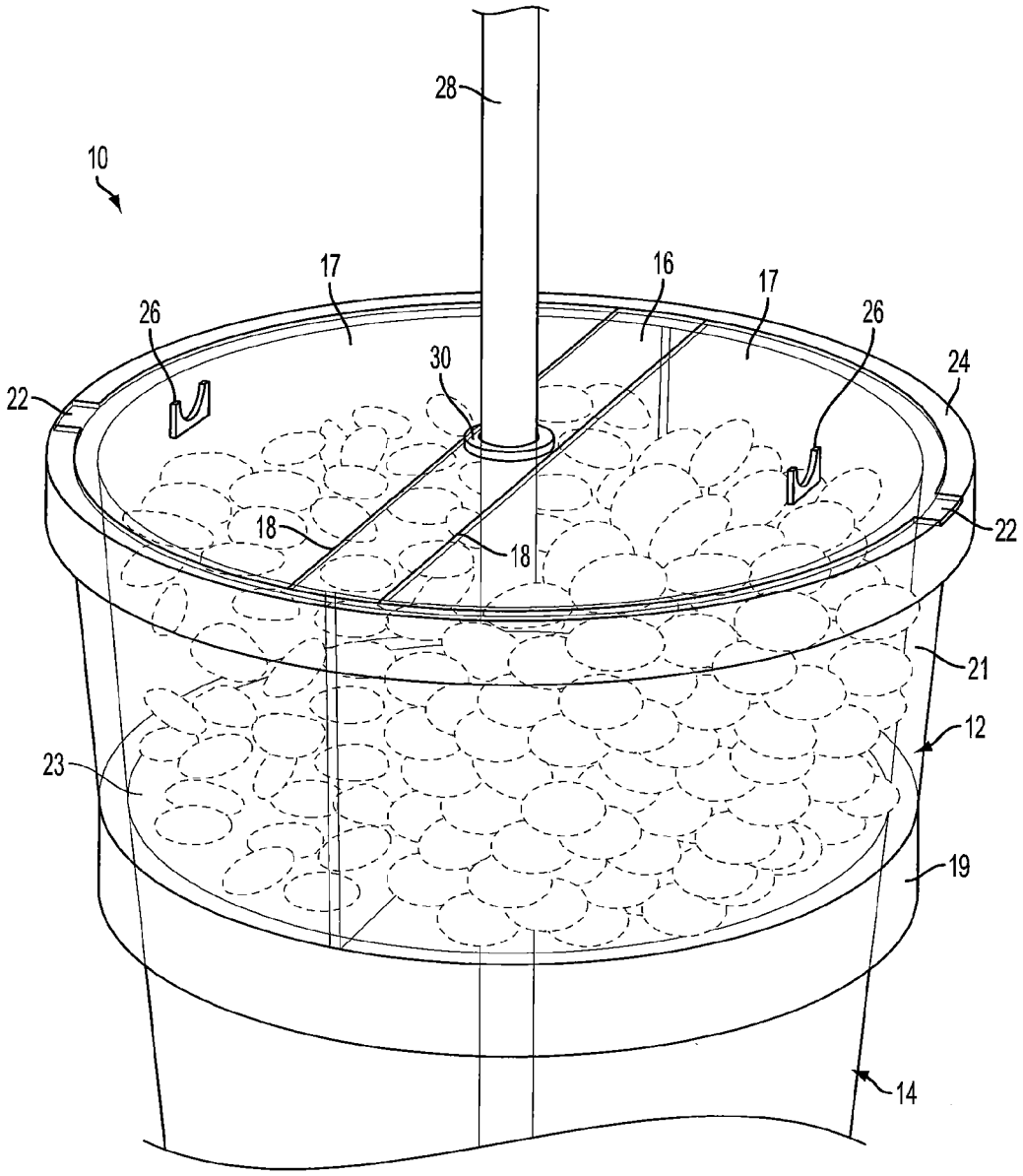
FIG. 2 is a close-up transparent, perspective view of the combination snack container and beverage container of FIG. 1 having dual hinged lids depicted in a closed position.

As shown best in FIGS. 1 and 2, the present disclosure is directed to a snack and beverage unit 10 comprised of a snack container 12 and a beverage container 14. In aspects of the disclosure, the snack container 12 may incude a dual lid 16, having dual lid portions 17, a beverage container engaging portion 19 shaped to engage a rim portion of a beverage container 14, at least one sidewall 21, and a floor 23. The dual lid portions 17 may be hinged to the lid 16 by hinges 18 allowing the dual lid portions 17 to pivot between open and closed positions. The dual lid portions 17 may also include tabs 20 on an outer periphery thereof which are shaped and sized to be received in corresponding friction fit slots 22 located on a rim edge 24 of the snack container 12. Preferably, the tabs 20 are slightly larger than the friction fit slots 22 so that they may be frictionally received therein in a snap-type fit.

In aspects of this embodiment, the dual lid portions 17 may include snap-fit clips 26 thereon that are shaped and sized to snap onto a straw 28. While such clips 26 may be of any design, preferably such clips 26 are shaped in a semi-circle configuration to provide an interference snap-type fit on straw 28. The clips 26 allow a user of the unit 10 to keep the lid portions 17 open to allow access to snacks in the snack container 12 as desired. In an embodiment, such as disclosed in FIGS. 1 and 2, wherein dual lid portions 17 are utilized, the clips 26 may be staggered on the lid portions 17 to prevent the clips 26 from interfering with each other when engaging the straw 28. The lid 16 may preferably be provided with an ingress opening 30 to provide an entry for the straw 28 through the lid, through an egress opening (not shown) and into the beverage container 14. In an embodiment of the disclosure, the snack container 12 may be provided with a partition 32 to allow a user of the snack container 12 to place two different snacks in the snack container 12 while simultaneously preventing intermixing thereof.

Figure 3:
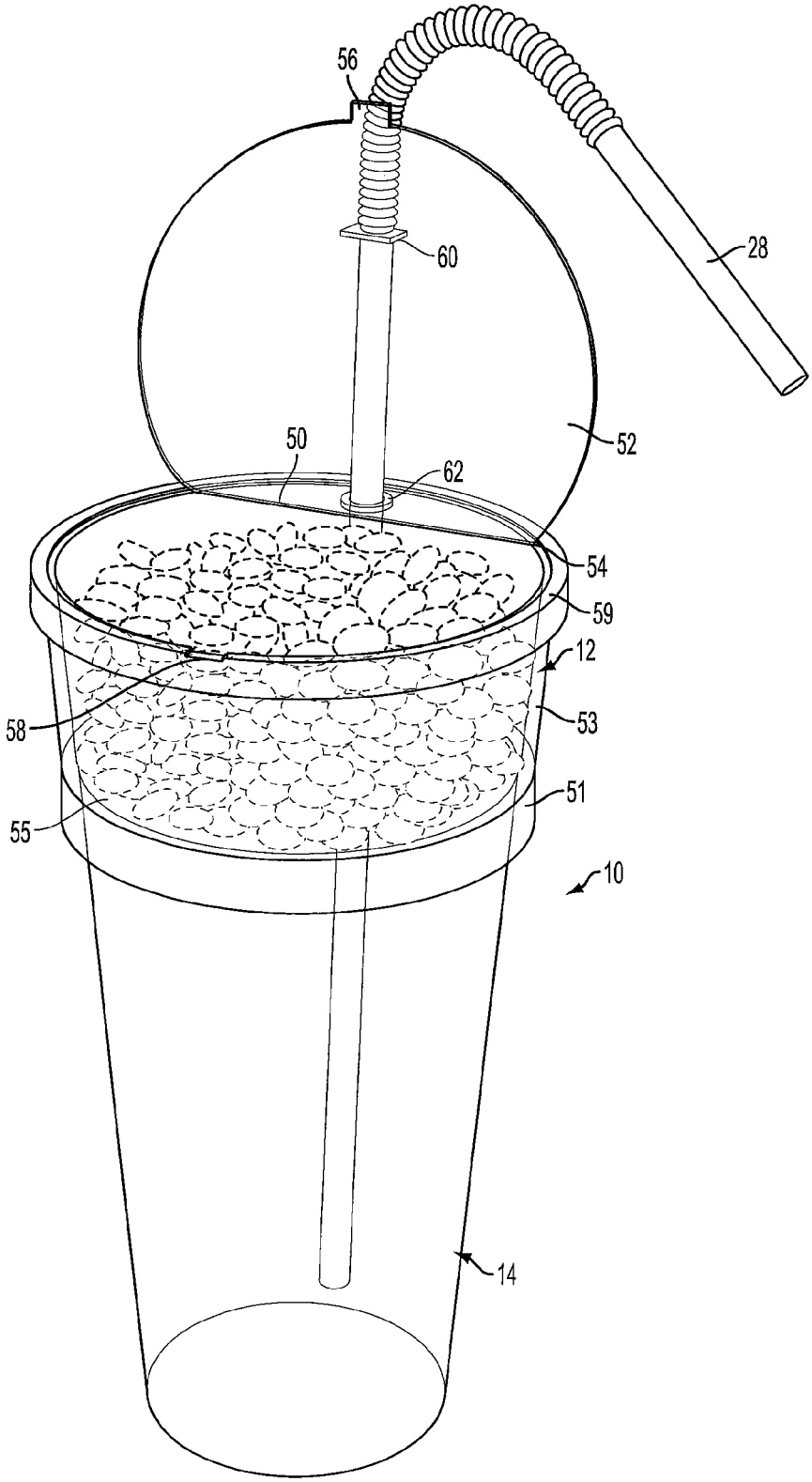
FIG. 3 is a transparent, perspective view of an alternate embodiment of a combination snack container and beverage container incorporated into a single unit in accordance with aspects of the present disclosure having a single hinged lid depicted in an open position.
Figure 4:
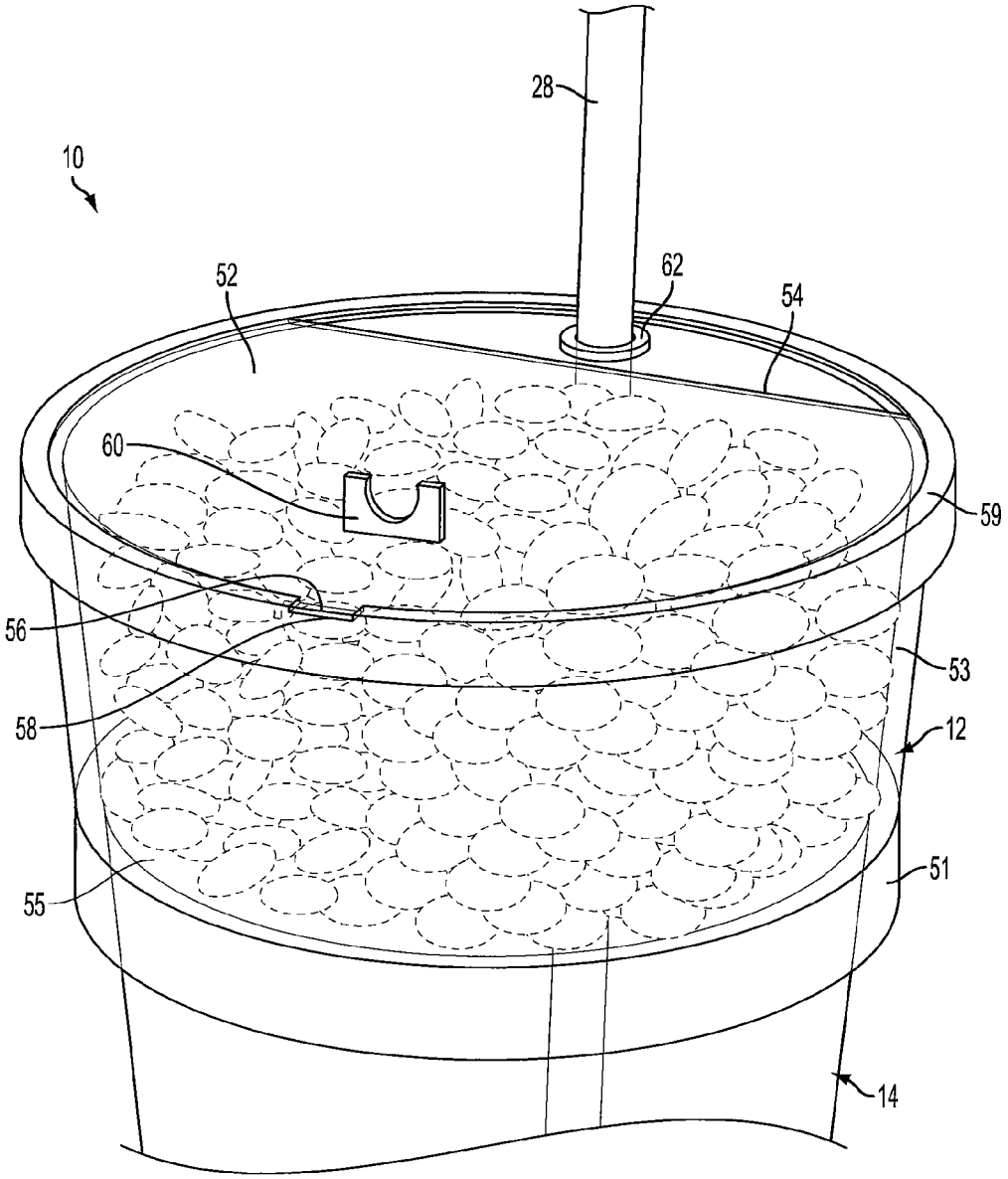
FIG. 4 is a close-up transparent, perspective view of the combination snack container and beverage container of FIG. 3 having a single hinged lid depicted in a closed position.

In aspects of the disclosure as shown best in FIGS. 3. and 4, the snack container 12 may incude a single lid 50, having a single lid portion 52, a beverage container engaging portion 51 shaped to engage a rim portion of a beverage container 14, at least one sidewall 53, and a floor 55. The single lid portion 52 may be hinged to the lid 50 by hinge 54 allowing the lid portion 52 to pivot between open and closed positions. The lid portions 52 may also include tab 56 on an outer periphery thereof which is shaped and sized to be received in a corresponding friction fit slot 58 located on a rim edge 59 of the snack container 12. Preferably, the tab 56 is slightly larger than the friction fit slot 58 so that it may be frictionally received therein in a snap-type fit.

In aspects of this embodiment, the single lid portion 52 may include a snap-fit clip 60 thereon that is shaped and sized to snap onto the straw 28. While such a clip 60 may be of any design, preferably such clip 60 is shaped in a semi-circle configuration to provide an interference snap-type fit on straw 28. The clip 60 allows a user of the unit 10 to keep the lid portion 52 open to allow access to snacks in the snack container 12 as desired. The lid 50 may preferably be provided with an ingress opening 62 to provide an entry for the straw 28 through the lid 50, through an egress opening (not shown) and into the beverage container 14.

Figure 5:
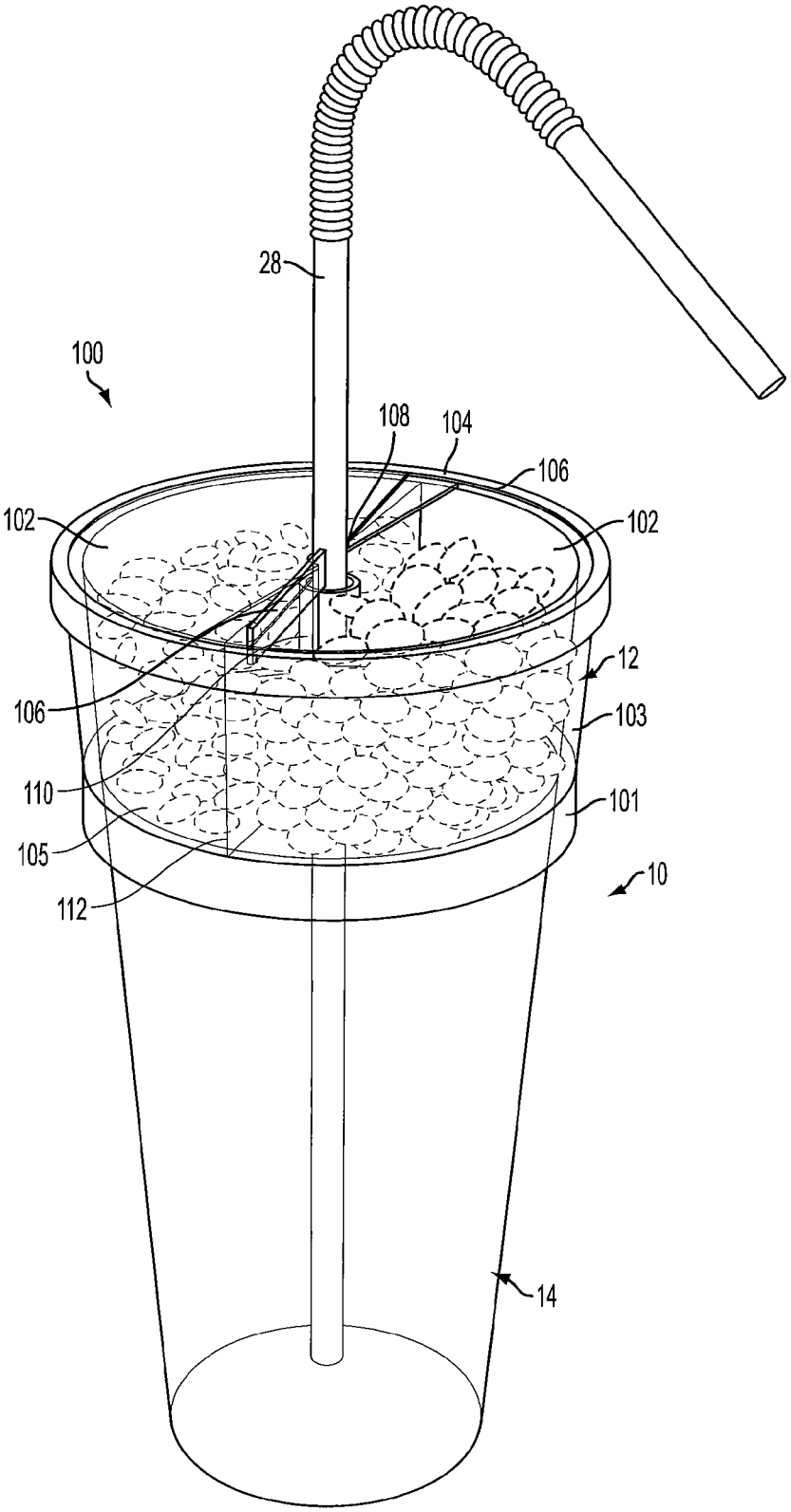
FIG. 5 is a transparent, perspective view of an alternate embodiment of a combination snack container and beverage container incorporated into a single unit in accordance with aspects of the present disclosure having a turn-style lid depicted in a partially closed position.
Figure 6:
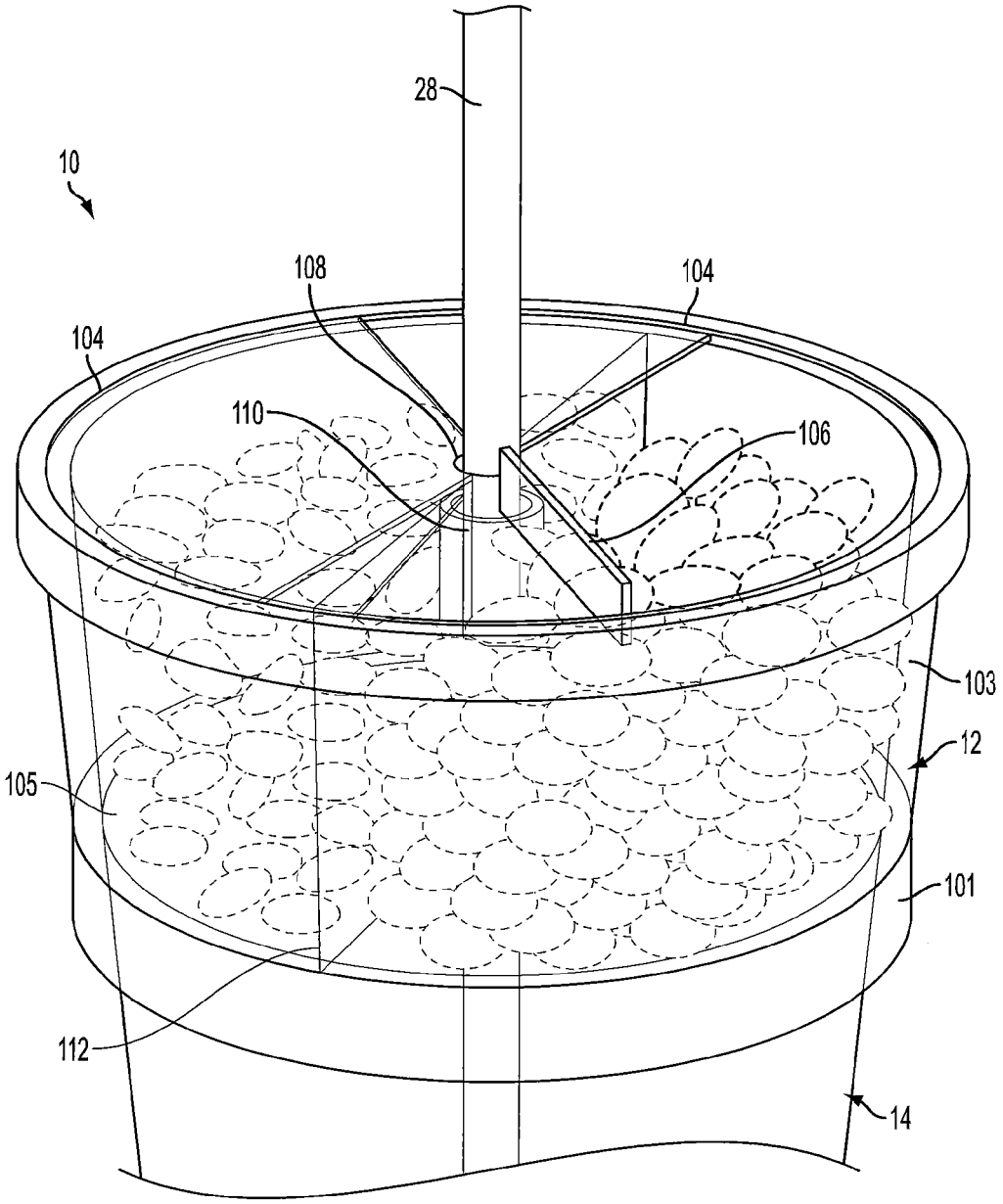
FIG. 6 is a close-up transparent, perspective view of the combination snack container and beverage container of FIG. 5 a having a turn-style lid depicted in a partially open position.

In aspects of the disclosure as shown best in FIGS. 5. and 6, the unit 10 may incude a turn-style lid 100 comprised of two semi-circular lid portions 102 mounted one on top of the other for pivoting movement within corresponding slots 104 on the lid 100, a beverage container engaging portion 101 shaped to engage a rim portion of a beverage container 14, at least one sidewall 103, and a floor 105. The lid portions 102 may include a handle 106 to allow the user to more easily manipulate movement of the lid portions 102.

In aspects of this embodiment, the lid 100 may preferably be provided with an ingress opening 108 including a channel 110 through the snack container 12 to provide an entry for the straw 28, which may then proceed through an egress opening (not shown) and into the beverage container 14. In an embodiment of the disclosure, the snack container 12 may be provided with a partition 112 to allow a user of the unit 10 to place two different snacks in the snack container 12 while simultaneously preventing intermixing thereof.

Figure 7:
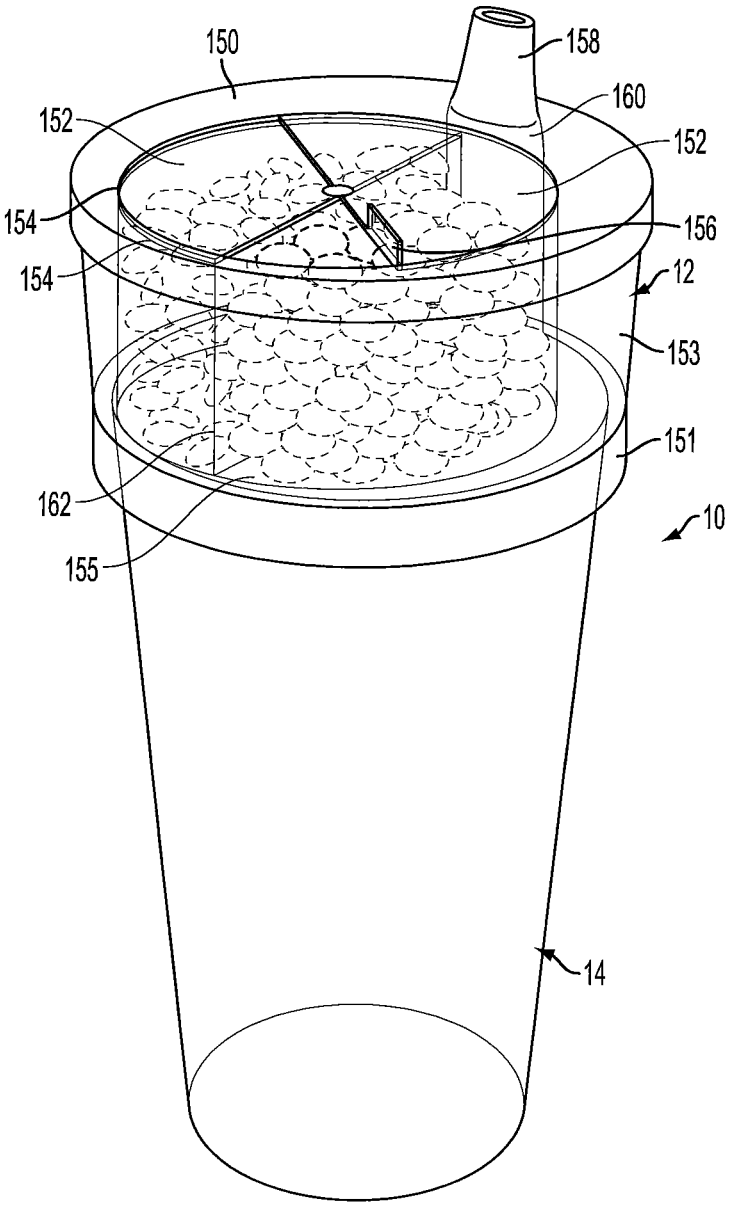
FIG. 7 is a transparent, perspective view of an alternate embodiment of a combination snack container and beverage container incorporated into a single unit in accordance with aspects of the present disclosure having a spout-style opening and a turn-style lid depicted in a closed position.
Figure 8:
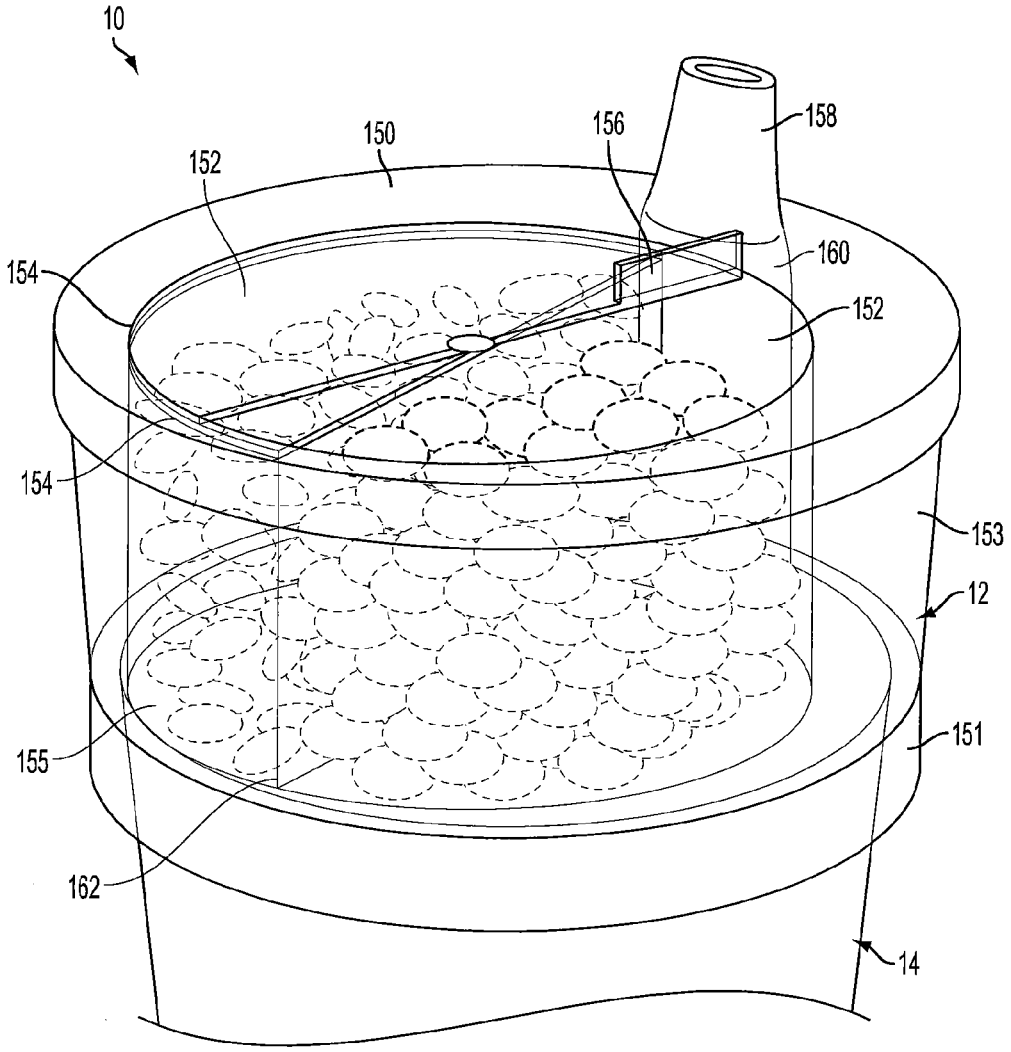
FIG. 8 is a close-up transparent, perspective view of the combination snack container and beverage container of FIG. 7 having a spout-style opening and a turn-style lid depicted in a partially closed position.

In aspects of the disclosure as shown best in FIGS. 7. and 8, the unit 10 may incude a turn-style lid 150 including therein two semi-circular lid portions 152 mounted one on top of the other for pivoting movement within corresponding slots 154 on the lid 150, a beverage container engaging portion 151 shaped to engage a rim portion of a beverage container 14, at least one sidewall 153, and a floor 155. The lid portions 152 may include a handle 156 to allow the user to more easily manipulate movement of the lid portions 152.

In aspects of this embodiment, the lid 150 may preferably be provided with a spout 158 including a channel 160 through the snack container 12 to an egress opening (not shown) to provide access for a user to a beverage located in the beverage container 14. In an embodiment of the disclosure, the snack container 12 may be provided with a partition 162 to allow a user of the unit 10 to place two different snacks in the snack container 12 while simultaneously preventing intermixing thereof.

Figure 9:
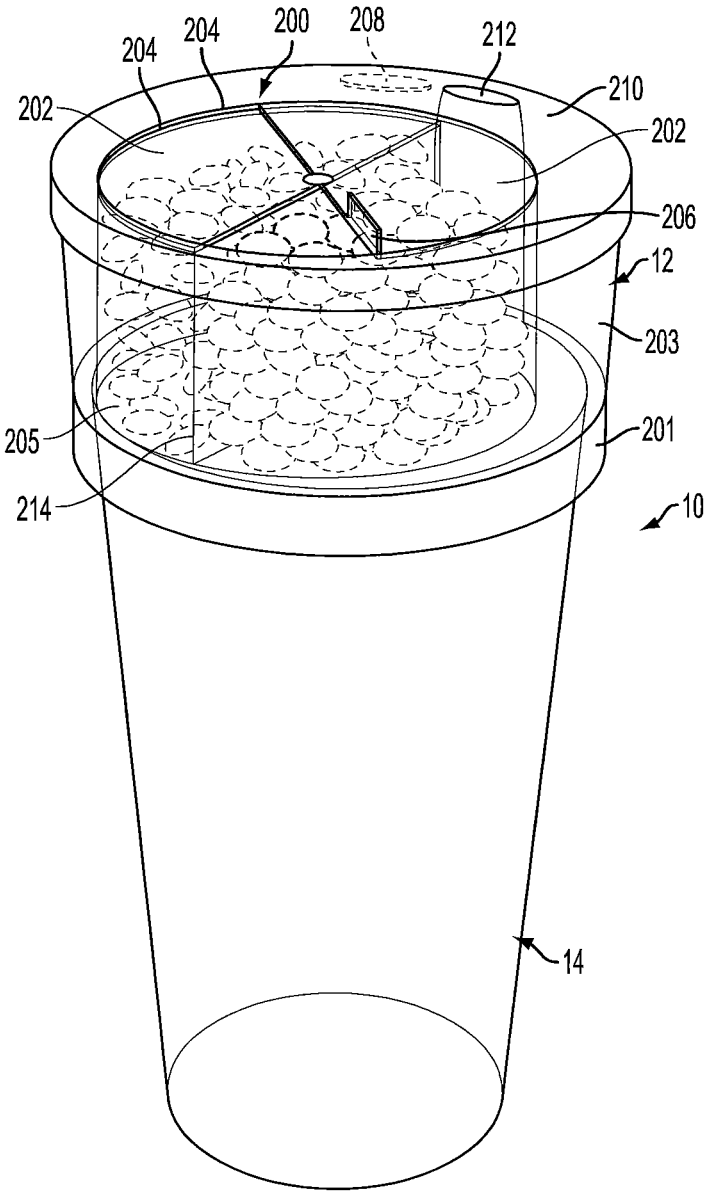
FIG. 9 is a transparent, perspective view of an alternate embodiment of a combination snack container and beverage container incorporated into a single unit in accordance with aspects of the present disclosure having a slit-style opening and a turn-style lid depicted in a closed snack and closed beverage position.

In aspects of the disclosure as shown best in FIGS. 9. and 10A and B, the unit 10 may incude a turn-style lid 200 comprised of two semi-circular lid portions 202 mounted one on top of the other for pivoting movement within corresponding slots 204 on the lid 200, a beverage container engaging portion 201 shaped to engage a rim portion of a beverage container 14, at least one sidewall 203, and a floor 205. The lid portions 202 may include a handle 206 to allow the user to more easily manipulate movement of the lid portions 202.

Figure 10A:
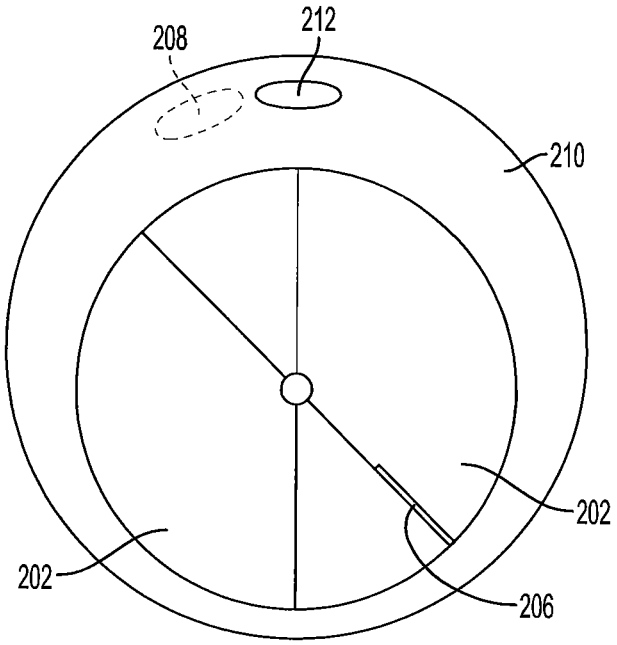
FIG. 10A is a top-plan view of the combination snack container and beverage container incorporated into a single unit of FIG. 9 depicted in an open snack and closed beverage position.
Figure 10B:
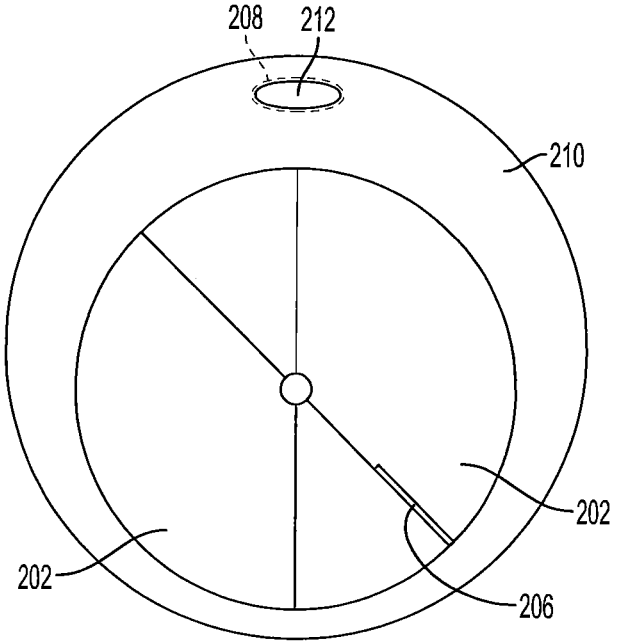
FIG. 10B is a top-plan view of the combination snack container and beverage container incorporated into a single unit of FIG. 9 depicted in an open snack and open beverage position.

In aspects of this embodiment, the lid 200 is mounted for rotational movement on the snack container 12. Accordingly, a slit 208 is preferably provided on the rim portion 210 of the lid 200 which is mounted for rotational movement on the snack container 12. A channel 212 is provided through the snack container 12 to an egress opening (not shown) to provide access for a user to a beverage located in the beverage container 14. Accordingly, as best shown in FIGS. 10A and 10B, a user can manipulate the lid 200 from a closed beverage configuration (FIG. 10A) to an open beverage configuration (FIG. 10B) by simply twisting the lid 200. In an embodiment of the disclosure, the snack container 12 may be provided with a partition 214 to allow a user of the unit 10 to place two different snacks in the snack container 12 while simultaneously preventing intermixing thereof.

Figure 11:
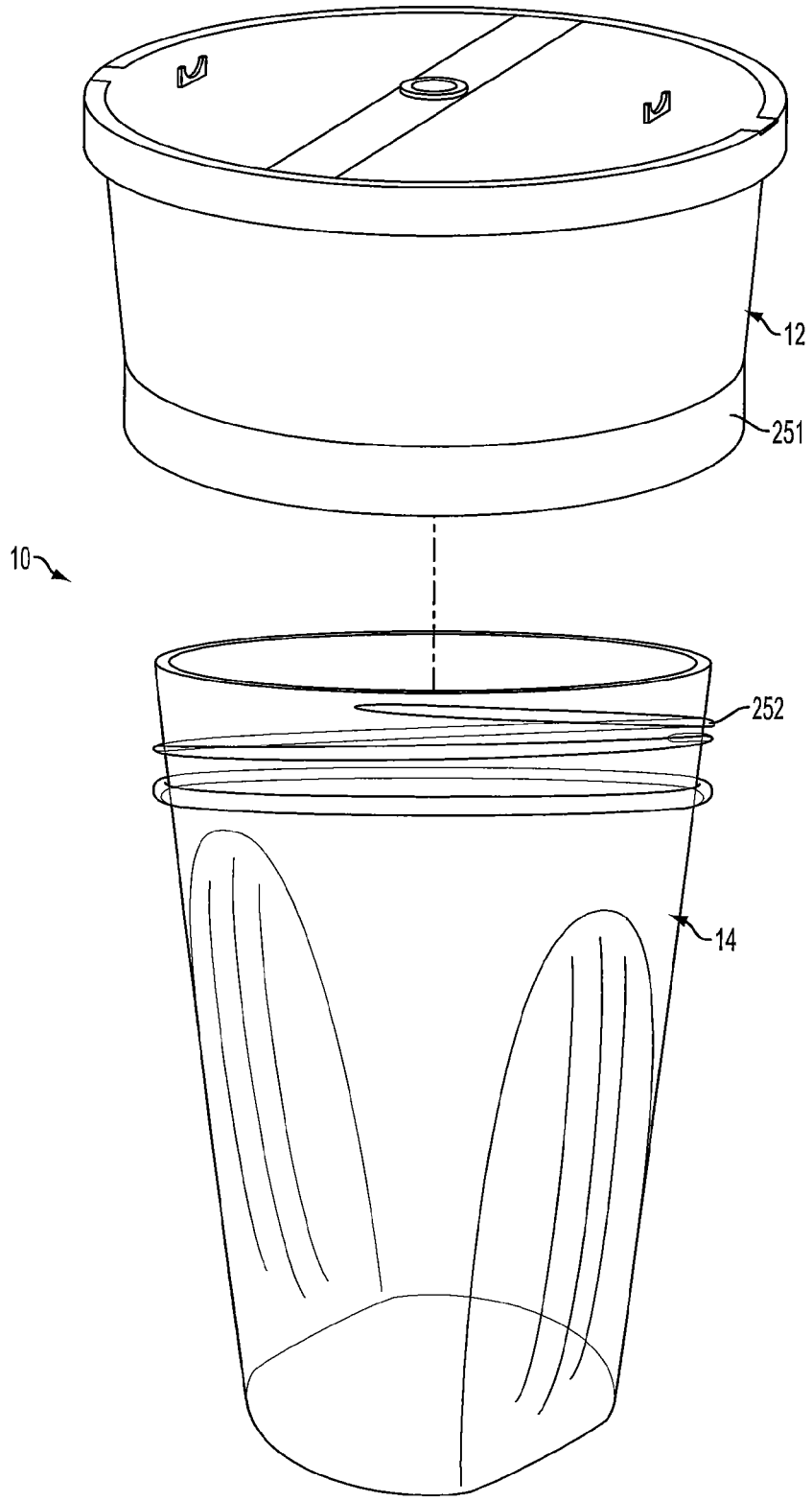
FIG. 11 is a is a transparent, perspective view of a combination snack container and beverage container incorporated into a single unit in accordance with aspects of the present disclosure showing a threaded beverage container shaped to be received by a snack container.
Figure 12:
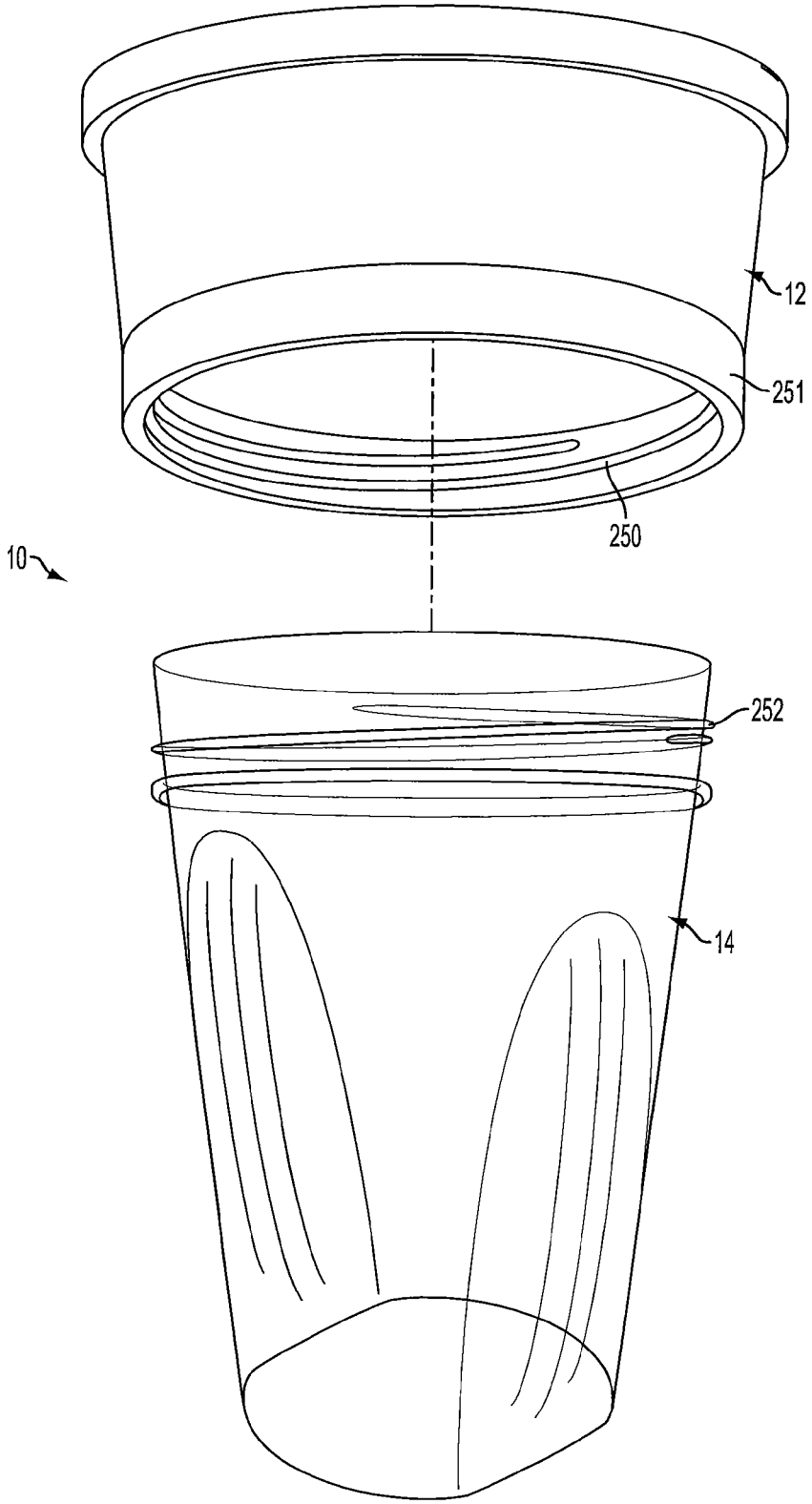
FIG. 12 is a is a transparent, perspective view of a combination snack container and beverage container incorporated into a single unit in accordance with aspects of the present disclosure showing a threaded beverage container shaped to be received by corresponding threads on a threaded snack container.

In aspects of the disclosure as shown best in FIGS. 11. and 12, the snack container 12 and beverage container 14 may be joined together by a threaded fit. Specifically, threads 250 on the beverage container engaging portion 251 of the snack container 12 may be shaped and sized to mate with corresponding threads 252 on the beverage container 14.

The many features and advantages of the disclosure are apparent from the detailed specification, and, thus, it is intended by the appended claims to cover all such features and advantages of the disclosure which fall within its true spirit and scope. Further, since numerous modifications and variations will readily occur to those skilled in the art, it is not desired to limit the disclosure to the exact construction and operation illustrated and described, and, accordingly, all suitable modifications and equivalents may be resorted to that fall within the scope of the disclosure.

I claim:

1. A beverage cup lid and integrated snack container comprising:

an annular beverage cup engaging portion including an annular shoulder shaped to seat upon an uppermost rim portion of a beverage cup mouth, at least one cylindrical outer sidewall extending axially upward from the cup engaging portion enclosing an elevated snack container area above the annular shoulder, a planar floor extending inward from the annular shoulder and closing off the snack container area from below the planar floor, the planar floor being at or above the elevation of the annular shoulder, an inner wall extending up from the planar floor and enclosing a beverage passage area, at least one planar lid portion removably covering the snack container area and coupled via a hinged connection approximate an upper end of the cylindrical outer sidewall allowing the lid portion to pivot between a vertically up open position and a horizontally down closed position, and a friction fit lock for maintaining the lid portion in the vertically up open position, the beverage passage area including an opening extending vertically therethrough to allow egress of beverage from a beverage cup when the beverage cup lid is seated upon the rim portion of the beverage cup, and the hinged connection being positioned diametrically between the lid portion and the beverage passage area so that the lid portion does not block the opening extending vertically through the beverage passage area when the lid portion is in the vertically up open position.

2. The beverage cup lid and integrated snack container of claim 1 wherein said friction fit lock of said lid portion includes a c-shaped clip extending therefrom adapted to clip onto a straw extending vertically through the opening in the beverage passage area when the lid portion is in the vertically up open position.

3. The beverage cup lid and integrated snack container of claim 1 wherein said lid portion includes a tab on an outer periphery thereof which is shaped and sized to be received in a corresponding friction fit slot located on an upper end of the cylindrical outer sidewall.

4. The beverage cup lid and integrated snack container of claim 1 wherein said opening in the beverage passage area comprises a straw ingress opening shaped and sized to receive a straw therethrough.

5. The beverage cup lid and integrated snack container of claim 1 wherein said beverage container engaging portion includes threads thereon shaped and sized to mate with corresponding threads on a beverage cup.

6. The snack container of claim 1 wherein said snack container includes a partition therein to allow a user of the snack container to place two different snacks in the snack container while simultaneously preventing intermixing thereof.

7. A snack container adapted for use with a beverage cup comprising: a snack container having an outer side wall and a floor, a lid covering the snack container, a beverage cup engaging portion on a lower end of the snack container at or below a level of the floor and shaped to engage an uppermost rim portion of a beverage cup mouth, wherein the lid includes at least one lid portion hinged to the lid allowing the lid portion to pivot between a vertical open position and a horizontal closed position and the snack container including an opening therethrough to allow egress of beverage from a beverage cup when attached to the beverage cup engaging portion of the snack container, wherein said opening comprises a straw ingress opening shaped and sized to receive a straw therethrough, through said snack container, and into a beverage cup when attached to the beverage cup engaging portion of the snack container, and wherein said lid portion incudes a clip thereon shaped to clip onto a straw when the lid portion is in the vertical open position and the straw extends vertically through the ingress opening to maintain said lid portion in its vertical open position, and to unclip from the straw when the lid portion is in the horizontal closed position.

8. The beverage cup lid and integrated snack container of claim 7 wherein the annular beverage cup engaging portion has a diameter sized to mate with an industry standard beverage cup taken from a group consisting of: a 12 oz. cup, a 16 oz. cup, a 24 oz. cup, a 36 oz. cup and a 44 oz. cup.

9. The beverage cup lid and integrated snack container of claim 7, wherein the hinged connection comprises a living hinge.

* * * * *